US005873607A

United States Patent [19]

Waggoner

[11] Patent Number: 5,873,607

[45] Date of Patent: Feb. 23, 1999

[54] CONSTRUCTION FOR A LAMINATED WINDOW LABEL

[75] Inventor: Bryce C. Waggoner, Monroe, Ohio

[73] Assignee: The Standard Register Company, Dayton, Ohio

[21] Appl. No.: 653,429

[22] Filed: May 24, 1996

[51] Int. Cl.[6] ..... B42D 15/00

[52] U.S. Cl. ..... 283/81; 283/101

[58] Field of Search ..... 283/81, 101, 105, 283/107, 109, 110; 428/40.1, 42

[56] References Cited

U.S. PATENT DOCUMENTS

| | | | |
|---|---|---|---|
| 3,383,121 | 5/1968 | Singer . | |
| 3,487,567 | 1/1970 | Waybright . | |
| 3,854,229 | 12/1974 | Morgan | 283/101 X |
| 4,184,701 | 1/1980 | Franklin et al. . | |
| 4,246,307 | 1/1981 | Trautwein | 283/101 X |
| 4,544,590 | 10/1985 | Egan . | |
| 4,608,288 | 8/1986 | Spindler . | |
| 4,721,638 | 1/1988 | Matsuguchi et al. | 283/101 X |
| 4,746,556 | 5/1988 | Matsuguchi et al. | 283/101 X |
| 4,763,930 | 8/1988 | Matney . | |
| 5,153,042 | 10/1992 | Indrelie . | |
| 5,294,470 | 3/1994 | Ewan . | |
| 5,330,232 | 7/1994 | Smith . | |
| 5,346,739 | 9/1994 | Nassoiy . | |
| 5,358,281 | 10/1994 | Greig . | |
| 5,466,502 | 11/1995 | Wilkinson et al. | 283/81 X |
| 5,518,787 | 5/1996 | Konkol . | |
| 5,582,434 | 12/1996 | Skov | 283/101 X |
| 5,588,679 | 12/1996 | Skov | 283/101 X |

FOREIGN PATENT DOCUMENTS

| | | |
|---|---|---|
| 66718/90 | 6/1992 | Australia . |
| 2243139 | 10/1991 | United Kingdom . |
| 9602048 | 1/1996 | WIPO . |

*Primary Examiner*—Frances Han

*Attorney, Agent, or Firm*—Killworth, Gottman, Hagan & Schaeff LLP

[57] ABSTRACT

A construction for a laminated window label is provided and includes a transparent film having an adhesive on one surface thereof, liner stock having first and second release-coated surfaces which is adhered on one surface to the transparent film, and an opaque layer which is adhered to the other surface of the liner stock. The transparent film and opaque layer preferably include die cut label portions. Variable and nonvariable information may be printed on the die cut label portion of the transparent film, and the opaque layer may be removed from the construction and replaced onto the surface of the film, thereby laminating the label portion of the opaque layer to the label portion of the transparent film. The two label portions may then be peeled away from the remainder of the construction as a single label which is then applied to a transparent surface such as a window. The opaque layer further includes a tamper-evident feature so that any attempt to remove the label produces a warning message on the transparent surface, the transparent film, and the opaque layer.

11 Claims, 6 Drawing Sheets

CONSTRUCTION FOR A LAMINATED WINDOW LABEL

BACKGROUND OF THE INVENTION

The present invention relates to a construction for producing a laminated label, and more particularly, to a construction which allows a laminated label to be adhered to and viewed through a transparent surface and which reveals a warning message if removal of the label is attempted.

It is well known in the art to place labels or decals which convey information on transparent surfaces such as windows. For example, labels for use on automobile windshields may contain information regarding auto club memberships, parking authorization, or vehicle inspection information.

Such labels are typically transparent so that they may be easily viewed from the exterior of a vehicle through a window, and may include variable and/or non-variable information. For example, Smith, U.S. Pat. No. 5,330,232 teach a window label which includes a transparent film layer carrying non-variable indicia which is adhered to a window on one surface and is adhered on the other surface to a separate bond sheet carrying variable indicia.

However, such labels may be subject to attempted removal and alteration. As labels or decals often convey identification information, it has become desirable to protect the stickers so that they cannot be altered or surreptitiously transferred to another surface. Accordingly, many labels have been developed which include a tamper-evident feature incorporated in the label. For example, U.S. Pat. No. 3,487,567 to Waybright teaches an automobile windshield sticker including a transparent plastic layer carrying indicia and a second plastic layer carrying identifying indicia which is applied in strips to certain areas over the transparent layer such that if removal of the second layer is attempted, a portion of the indicia on the transparent layer is removed. However, the label construction is complex in that indicia is provided on separate layers and a plurality of opaque and colored paint layers are required to provide the desired protection.

Accordingly, there is still a need in the art for an improved construction for a printable window label which may include variable and nonvariable indicia, which is easy to manufacture and use, and which includes a tamper-evident feature.

SUMMARY OF THE INVENTION

The present invention meets that need by providing a construction for producing a laminated window label which may be adhered to a transparent surface. The label may be printed with both variable and nonvariable indicia, and may be imaged by a number of printing techniques including thermal transfer, ink jet, laser, LED, dye sublimation and impact.

In accordance with one embodiment of the invention, a construction for producing a laminated window label is provided comprising a transparent film having first and second major surfaces in which the first surface is adapted to receive printed indicia and the second surface includes an adhesive thereon. The transparent film preferably comprises polyester, although other transparent polymers may be utilized.

The construction further includes liner stock having first and second major surfaces with each of the first and second surfaces including a release coating thereon. In one embodiment of the invention, the liner stock comprises a single liner ply. In an alternative embodiment, the liner stock comprises a first liner ply and a second liner ply which are adhered together with an adhesive. Preferably, the release coating on the first surface of the liner stock is adhered to the adhesive on the second surface of the transparent film.

The construction also includes an opaque layer having first and second surfaces which includes an adhesive on its first surface which is adhered to the release coating on the second surface of the liner stock. The opaque layer is adapted to be removed from the second surface of the liner stock and adhered to the first surface of the transparent film such that the transparent film and opaque layer may be removed as a single label from the construction and adhered to a transparent surface such as a window.

The opaque layer preferably comprises a polyester film having an opaque pigment thereon. The opaque layer also preferably includes a tamper evident feature such that if an attempt is made to remove the laminated window label from the transparent surface to which it is adhered, a portion of the opaque pigment remains on the transparent surface and a portion remains on the transparent film, forming a warning message on the transparent surface, transparent film and the opaque layer. The warning message may be in the form of a pattern of warning words such as "VOID".

In a preferred embodiment of the invention, the transparent film and the opaque layer each include a die cut label portion. The label portions are preferably removed from the construction to form the single label. In one embodiment, the die cut label portion of the opaque layer is larger than the die cut label portion of the transparent film such that when the single label is applied to a transparent surface, the opaque layer adheres to the transparent surface as well as to the transparent film. Preferably, the peripheral matrices surrounding the die cut label portion of the transparent film and the opaque layer are removed from the construction prior to use.

The construction of the present invention is preferably in the form of a continuous web comprising a series of label constructions.

The present invention also provides a method of making a laminated window label carrying printed indicia comprising the steps of providing a construction comprising a transparent film having first and second major surfaces, the second surface including an adhesive thereon, liner stock having first and second major surfaces including a release coating thereon, with the release coating on the first surface being adhered to the adhesive on the second surface of the transparent film, and an opaque layer having first and second surfaces, with the first surface including an adhesive which is adhered to the release coating on the second surface of the liner stock. Indicia is then printed onto the first surface of the transparent film. Indicia printed on the transparent film is preferably reverse printed (i.e., is printed as a mirror image) so that the printing is readable through the transparent surface to which the label is applied.

Preferably, the method also includes the steps of die cutting a label portion in the transparent film and the opaque layer.

After indicia is printed on the first surface of the transparent film, the opaque layer is then removed from the construction and replaced adhesive side down onto the first surface of the transparent film, thereby laminating the opaque layer over the transparent film. The transparent film and the opaque layer are then peeled away together from the remainder of the construction to form a single label, and the label is placed adhesive side down onto a transparent surface.

In its final form, the laminated window label is adhered to a transparent surface such that the second surface of the transparent film containing adhesive is in contact with the transparent surface, and the opaque layer is adhered to the first surface of the transparent film. If an attempt is made to remove the label from the transparent surface, a warning message will appear on the transparent surface, on the transparent film, and on the opaque layer.

In an alternative method of making the laminated label, indicia may be printed on the second surface of the opaque layer. In this embodiment, the indicia is not reverse printed. The transparent film is then removed from the construction and replaced adhesive side down onto the second surface of the opaque layer, laminating the transparent film onto the opaque layer. The transparent film and the opaque layer are then peeled away from the remainder of the construction to form a single label. The label is then placed adhesive side down onto the desired surface. In this embodiment, it is not necessary that the surface be transparent since the indicia are viewed through the transparent film rather than through the surface to which the label is adhered.

In this embodiment, it is preferred that the die cut label portion of the transparent film be larger than the die cut label portion of the opaque layer such that the transparent film adheres to the transparent surface as well as to the opaque layer.

Accordingly, it is a feature of the invention to provide a laminated window label construction which includes a tamper-evident feature. It is a further feature of the invention to provide a method of making such a laminated label. These, and other features and advantages of the present invention will become apparent from the following detailed description, the accompanying drawings, and the appended claims.

DETAILED DESCRIPTION OF THE PREFERRED EMBODIMENT

Figure 1A:
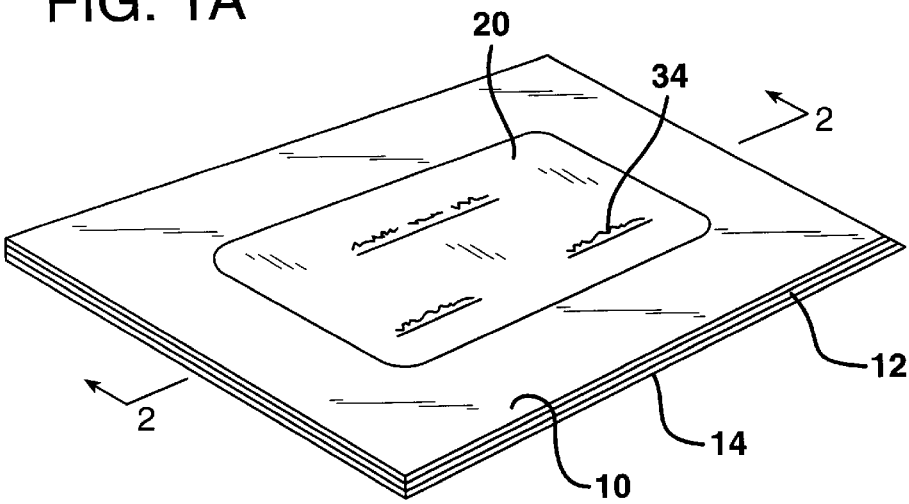
FIG. 1A is a top perspective view of the window label construction of the present invention.
Figure 1B:
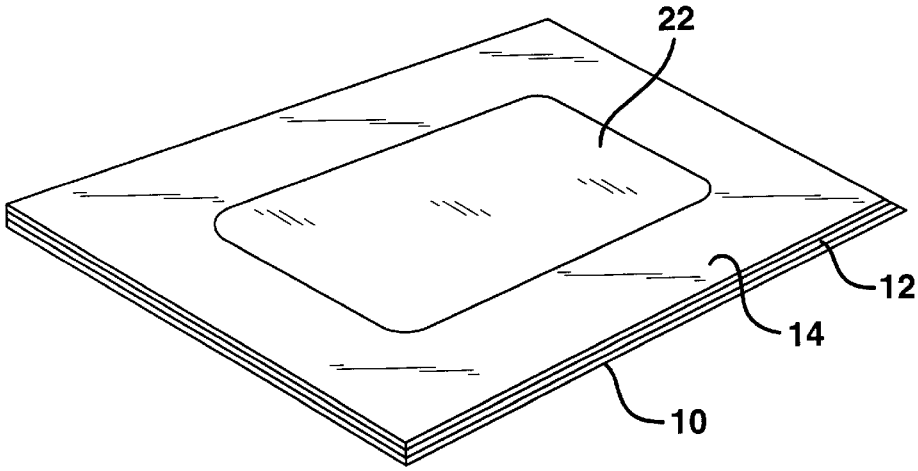
FIG. 1B is a bottom perspective view of the window label construction of the present invention.
Figure 2:
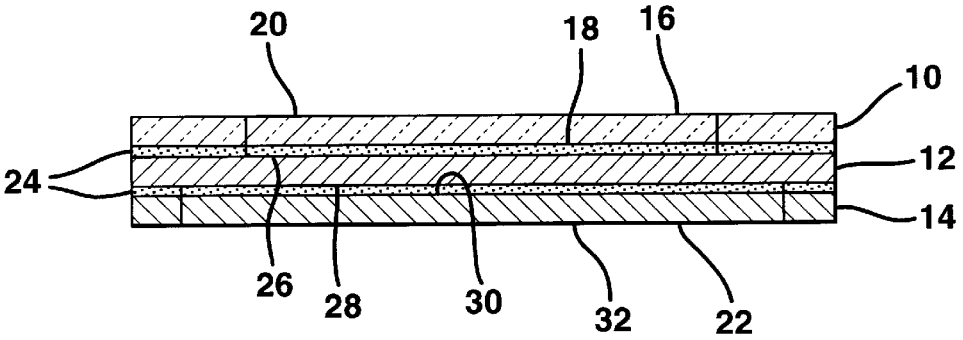
FIG. 2 is a cross-sectional view of one embodiment of the label construction shown along line 2—2 in FIG. 1.

The construction for the laminated window label of the present invention is illustrated in FIGS. 1 and 2 and comprises a transparent film 10 having first and second surfaces 16 and 18. The transparent film preferably comprises polyester, but may also comprise any other suitable transparent polymer or a translucent material, such as glassine. A preferred commercially available transparent film is a 2 mil polyester film available from Meyercord under the designation Sentinel Tamper Evident Film. The film includes an adhesive on one side which is covered with a release liner.

The first surface 16 of the transparent film is adapted to receive printed indicia and preferably includes a die cut label portion 20 as shown in FIG. 1A. As shown in FIG. 2, the second surface 18 of the transparent film preferably includes an adhesive 24, which is preferably a permanent adhesive.

The construction also includes liner stock 12 having first and second major surfaces 26 and 28. In the embodiment shown in FIG. 2, the liner stock is comprised of a single liner ply coated with release material on both surfaces. The release coating on the first surface 26 of the liner stock is adhered to the adhesive 24 on the second surface 18 of the transparent film. In an alternative embodiment illustrated in FIG. 3, the liner stock comprises first and second liner plies 12 which are adhered together by an adhesive 24.

The construction also includes an opaque layer 14 having first and second surfaces 30 and 32. The opaque layer includes an adhesive 24 on its first surface 30 which is adhered to the release coating on the second surface 28 of liner stock 12. As shown in FIGS. 1B and 2, the opaque layer also includes a die cut label portion 22.

The opaque layer preferably comprises a polyester film and contains a tamper-evident feature that becomes visible if the label is removed from the surface to which it is adhered. The opaque layer is commercially available in the form of label stock from the 3M Company under the designation SecurMark™ or from Flexcon Co., Inc., under the designation Tamper-Mark™. The label stock essentially comprises a polyester film which has been coated in certain areas with a silicone release coating to form warning words such as "VOID". An opaque pigmented layer is then coated over the film to form a background color, and an adhesive is laminated over the opaque layer and covered with a release liner.

Figure 3:
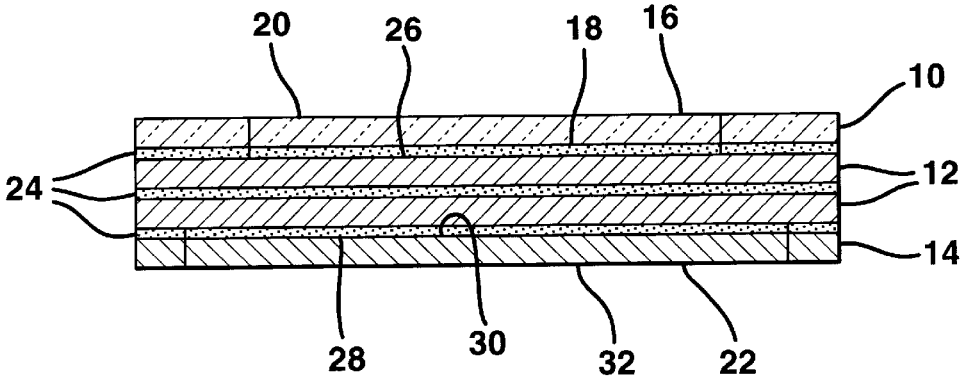
FIG. 3 is a cross-sectional view of another embodiment of the label construction.

The cross-section of the construction illustrated in FIGS. 2 and 3 shows die cut label portion 22 of opaque layer 14 extending beyond the die cut label portion 20 of transparent film 10. This construction is preferred such that when the label portions are removed from the construction and adhered to a transparent surface as a single label, the die cut label portion 22 adheres to the transparent surface as well as the die cut label portion 20 of the transparent film. This also provides an advantage in that the transparent film is completely laminated by the opaque layer. However, it should be appreciated that the opaque layer may be the same size as or smaller than the transparent film, as long as the printed indicia on the transparent film are covered.

The construction of the present invention is preferably produced as a continuous web product which may be fan-folded as shown in FIG. 3, or wound into a roll. In a preferred method of making the construction, the transparent film and opaque layers are fed from a label press and their respective release liners are joined together with an adhesive, such as a permanent adhesive. It is also possible to use a single release-coated liner ply and adhere the transparent film and opaque layer to opposite surfaces of the ply.

Nonvariable indicia is then reverse printed onto the first surface of the transparent film, preferably using a thermal transfer printer. The transparent film is reverse printed so that when the label is applied to the inside of a window, it may be read from the outside.

Nonvariable information printed on the label may include, for example, legends to be used in connection with a vehicle inspection label such as "Name", "Address", and "Vehicle ID No.". Machine readable information such as bar codes may also be preprinted on the transparent film. Multiple print colors may also be utilized.

After preprinted information is added to the transparent film, the web is advanced through two die cutting stations where label portions 20 and 22 are die cut in the opaque layer and transparent film extending down to the liner stock. The peripheral matrices around the respective label portions are then preferably removed.

Figure 4:
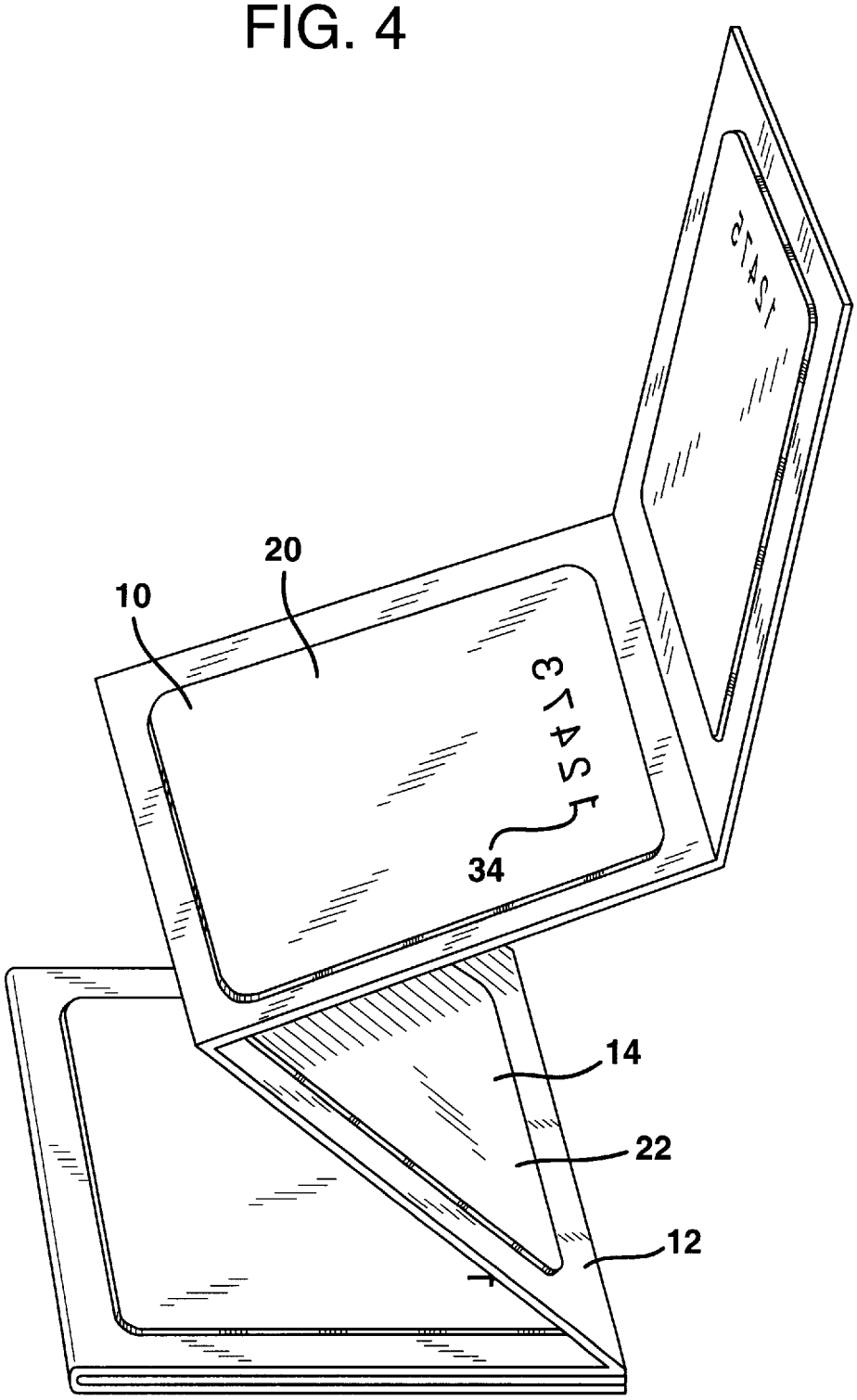
FIG. 4 is a perspective view of a continuous web of labels in accordance with the present invention.

The continuous web product is then ready for shipment to a customer where variable information may be added to the transparent film by the end user. Because of the uniform thickness of the label construction, the label portion may be printed with information by a number of different printing devices including thermal transfer, ink jet, laser, LED, dye sublimation, or impact printers. Preferably, the variable indicia is reverse printed onto the transparent film as shown in FIG. 4. As illustrated in FIG. 1, indicia 34 may be printed onto the first surface 16 of the transparent film within the die cut label portion 20.

As illustrated in FIGS. 5A–5E, once indicia have been printed onto surface 16, the die cut label portion 22 of opaque layer 14 is removed from the construction and placed adhesive side down onto the first surface 16 of label portion 20 of the transparent film, thereby laminating the opaque layer over the transparent film.

Figure 5A:
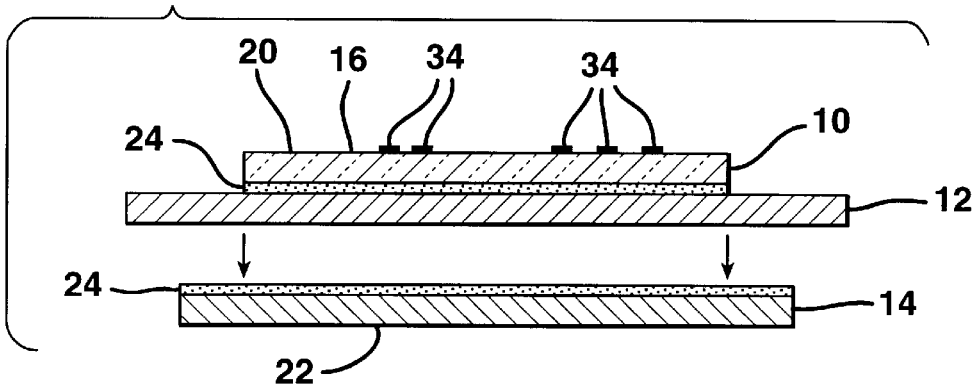
FIGS. 5A through 5E are cross-sectional views illustrating the preferred method of applying the laminated window label to a transparent surface.
Figure 5B:
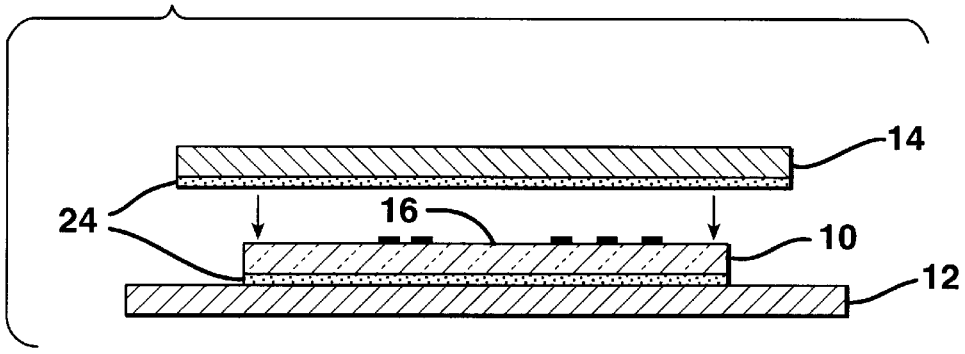
Figure 5C:
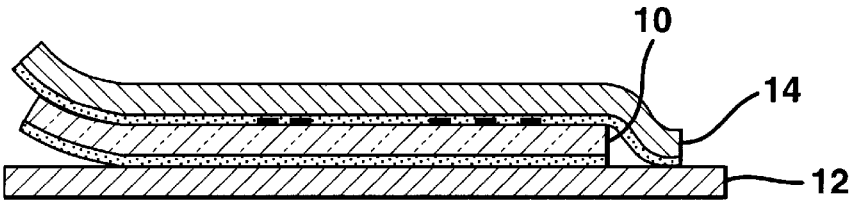
Figure 5D:
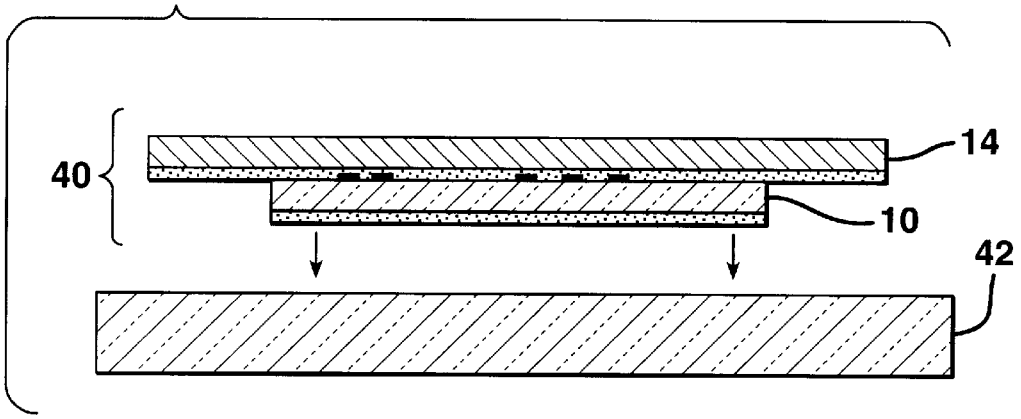

The die cut label portions 20, 22 are then both peeled away together from the remainder of the construction to form a single label 40 as shown in FIG. 5D. The label is then placed adhesive side down onto a transparent surface 42 such as a window or the inside of an automobile windshield.

While the preferred label construction described herein is designed to be applied to the inner surface of a window, it is also possible to use the same label construction and apply the label to the outer surface of a window or on other surfaces. For example, indicia may be printed (normally) on the second surface 32 of the opaque layer 14, and the transparent layer 10 may be removed from the construction and replaced adhesive side down onto the second surface 32 of the opaque layer. In this instance, it is preferred that the transparent film be die cut so as to extend beyond the edges of the opaque layer. The use of the label construction in this manner provides an advantage in that indicia does not have to be reverse printed onto the opaque layer, and the label does not have to be adhered to a transparent surface.

Figure 5E:
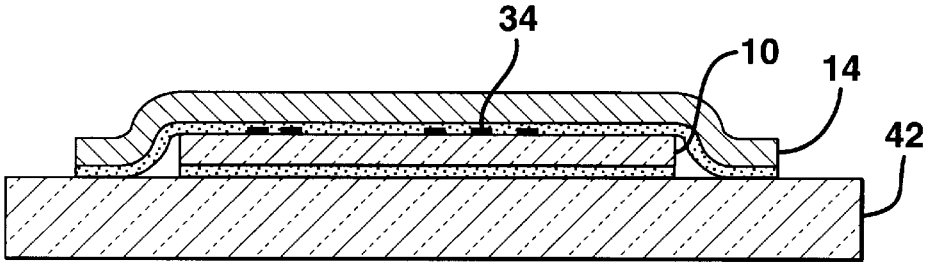
Figure 6:
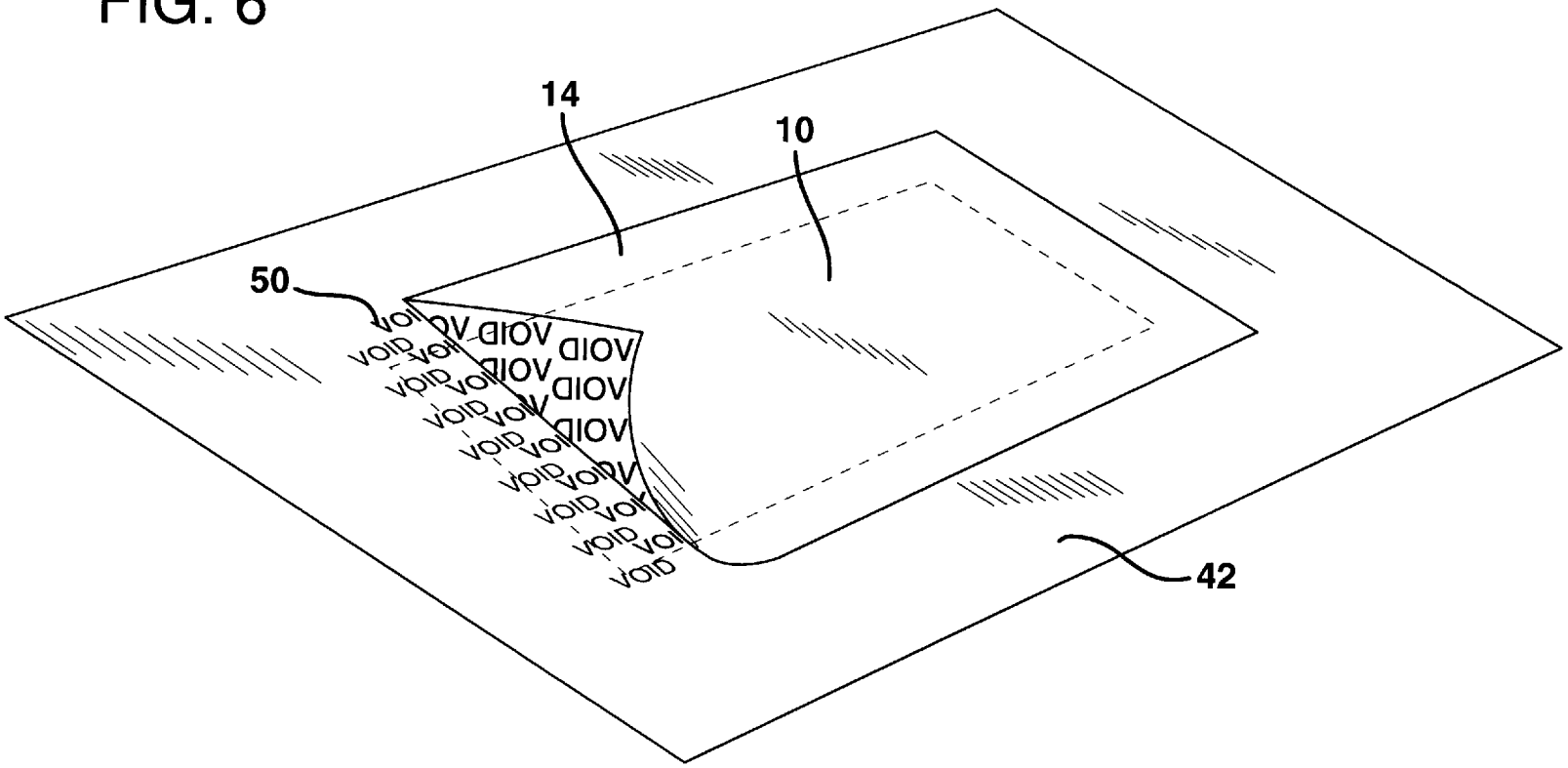
FIG. 6 is a perspective view illustrating the tamper-evident feature of the opaque layer.

The completed laminated window label is illustrated in FIG. 5E. As shown, the transparent film carrying printed indicia 34 is protected by the opaque layer 14. As shown in FIG. 6, if an attempt is made to remove the label from the surface to which it is adhered, a warning message 50 will appear on those portions of the transparent surface which was covered with the opaque layer as well as on the transparent film 10. In addition, the portions of the opaque pigment which have been removed from the opaque layer 14 form a warning message on the opaque layer.

The window label of the present invention provides several advantages in that a laminated, tamper-proof label is easily provided without requiring separate printing and laminating steps. In addition to providing a tamper-evident feature, the opaque layer also protects the transparent film and provides resistance to wear, smearing and moisture.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A construction for producing a laminated window label comprising:

a transparent film having first and second major surfaces, said first surface being adapted to receive indicia and said second surface including an adhesive thereon;

liner stock having first and second major surfaces, each of said first and second surfaces including a release coating thereon, said release coating on said first surface being adhered to said adhesive on said second surface of said transparent film; and an opaque layer having first and second surfaces and including an adhesive on said first surface which is adhered to said release coating on said second surface of said liner stock, wherein said opaque layer is adapted to be removed from said second surface of said liner and adhered to said first surface of said transparent film such that said transparent film and said opaque layer may be removed as a single label from said construction and adhered to a transparent surface.

2. The construction of claim 1 in which said liner stock comprises a single liner ply.

3. The construction of claim 1 in which said liner stock comprises a first liner ply and a second liner ply adhered together with an adhesive.

4. The construction of claim 1 in which said transparent film and said opaque layer each include a die cut label portion.

5. The construction of claim 4 in which the die cut label portion of said opaque layer is larger than the die cut label portion of said transparent film.

6. The construction of claim 4 in which the peripheral matrices surrounding said die cut label portion of said transparent film and said opaque layer have been removed from said construction.

7. The construction of claim 1 in which said transparent film comprises polyester.

8. The construction of claim 1 in which said opaque layer comprises a polyester film having an opaque pigment thereon.

9. The construction of claim 8 in which said opaque layer includes a tamper evident feature such that if an attempt is made to remove said label from said transparent surface, a portion of said opaque pigment remains on said transparent surface and a portion remains on said transparent film, forming a warning message on said transparent surface, said transparent film, and said opaque layer.

10. The construction of claim 1 being in the form of a continuous web comprising a series of label constructions.

11. A laminated window label adhered to a transparent surface comprising:

a transparent film having first and second major surfaces, said first surface containing indicia and said second surface including an adhesive thereon which is in contact with said transparent surface;

an opaque layer having first and second surfaces and including an adhesive on said first surface which is adhered to said first surface of said transparent film, said opaque layer comprising a film including an opaque pigment thereon, said opaque layer further including a tamper evident feature such that if an attempt is made to remove said label from said transparent surface, a portion of said opaque pigment remains on said transparent surface and a portion remains on said transparent film, forming a warning message on said transparent surface, said transparent film, and said opaque layer.

* * * * *